US005609260A

United States Patent [19]

Liao

[11] Patent Number: 5,609,260

[45] Date of Patent: Mar. 11, 1997

[54] DERRICK STRUCTURE

[76] Inventor: Fu-Chang Liao, No. 20, Alley 10, Lane 99, Chunghua Rd., Chunan Chen, Miaoli Hsien, Taiwan

[21] Appl. No.: 596,512

[22] Filed: Feb. 5, 1996

[51] Int. Cl.[6] ..... B66C 23/76

[52] U.S. Cl. ..... 212/279; 212/198

[58] Field of Search ..... 212/198, 279, 212/225, 195, 196, 197, 223

[56] References Cited

U.S. PATENT DOCUMENTS

| | | | |
|---|---|---|---|
| 2,453,082 | 11/1948 | Allard | 212/93 |
| 4,067,446 | 1/1978 | Ray | 212/279 |

FOREIGN PATENT DOCUMENTS

| | | | |
|---|---|---|---|
| 169627 | 4/1951 | Germany | 212/198 |
| 1101890 | 1/1968 | United Kingdom | 212/198 |

*Primary Examiner*—Thomas J. Brahan
*Attorney, Agent, or Firm*—Hedman, Gibson & Costigan, P.C.

[57] ABSTRACT

An improved derrick structure comprising a column for supporting the derrick structure, a bracket horizontally rotatably mounted on the column, a boom vertically pivoted on the bracket so that the boom is divided into a first boom portion and a second boom portion, a winch drivable to hoist a hook for engaging an article intended to be transported by the derrick structure, a first dolly drivable to move the hook along the first boom portion, a counterweight drivable to move along the second boom portion to effectively balance the loading of the article hoisted by the derrick structure, and a controlling device for activating an electrical control circuit to control the driving of the winch, the dolly and the counterweight.

8 Claims, 6 Drawing Sheets

DERRICK STRUCTURE

FIELD OF THE INVENTION

The present invention is related to a derrick, particularly to a derrick which has a counterweight that is movable along a boom of the derrick.

BACKGROUND OF THE INVENTION

In a modern high building construction site, a derrick is often utilized to hoist heavy articles, for example, steel beams, to a desired location. However, the conventional derrick has disadvantages that since its counterweight is fixed in position and has a fixed weight, a loading of the heavy articles hoisted by the derrick cannot be effectively balanced by the counterweight, which causes that a frame of the derrick must have a very strong structure. This means that the parts constituting the frame should have a large size or be made by steel having a high strength which correspondingly means that these parts involve a high cost.

Furthermore, since the loading cannot be balanced, an unbalanced force will act on a bearing of a boom of the derrick, which causes the bearing to be damaged very easily.

Moreover, the conventional derrick cannot provide a secure manner which can ensure that the load the derrick is preparing to hoist will not exceed the rating loading that the conventional derrick is designed to hoist.

Finally, when the conventional derrick starts hoisting an article, it will always apply a sudden large hoisting force on the article or container of the article for the hoisting operation. Such an application of a sudden large force will cause a damage to the article or the container thereof.

The present invention is disclosed to obviate/mitigate the above mentioned disadvantages of the conventional derrick.

SUMMARY OF THE INVENTION

It is an objective of the present invention to provide a derrick in which a position of its counterweight is variable thereby to effectively balance the loading of an article that is hoisted by the present derrick.

A further objective of the present invention is to provide a derrick in which parts for constituting a frame thereof can be made in a low cost.

It is a further objective of the present invention to provide a derrick in which a bearing for the boom thereof to rotate about is substantially subjected to a balanced force during an operation of the derrick.

It is still a further objective of the present invention to provide a derrick which can provide a secure manner to ensure that the loading of the article hoisted by the present derrick will not exceed the rating loading that the present derrick is designed to hoist.

It is another further objective of the present invention to provide a derrick in which during an initial hoisting operation of the present derrick, it will apply a gradually increasing force on the article or a container thereof that is hoisted by the present derrick so that the chance to damage the article or the package thereof can be reduced.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
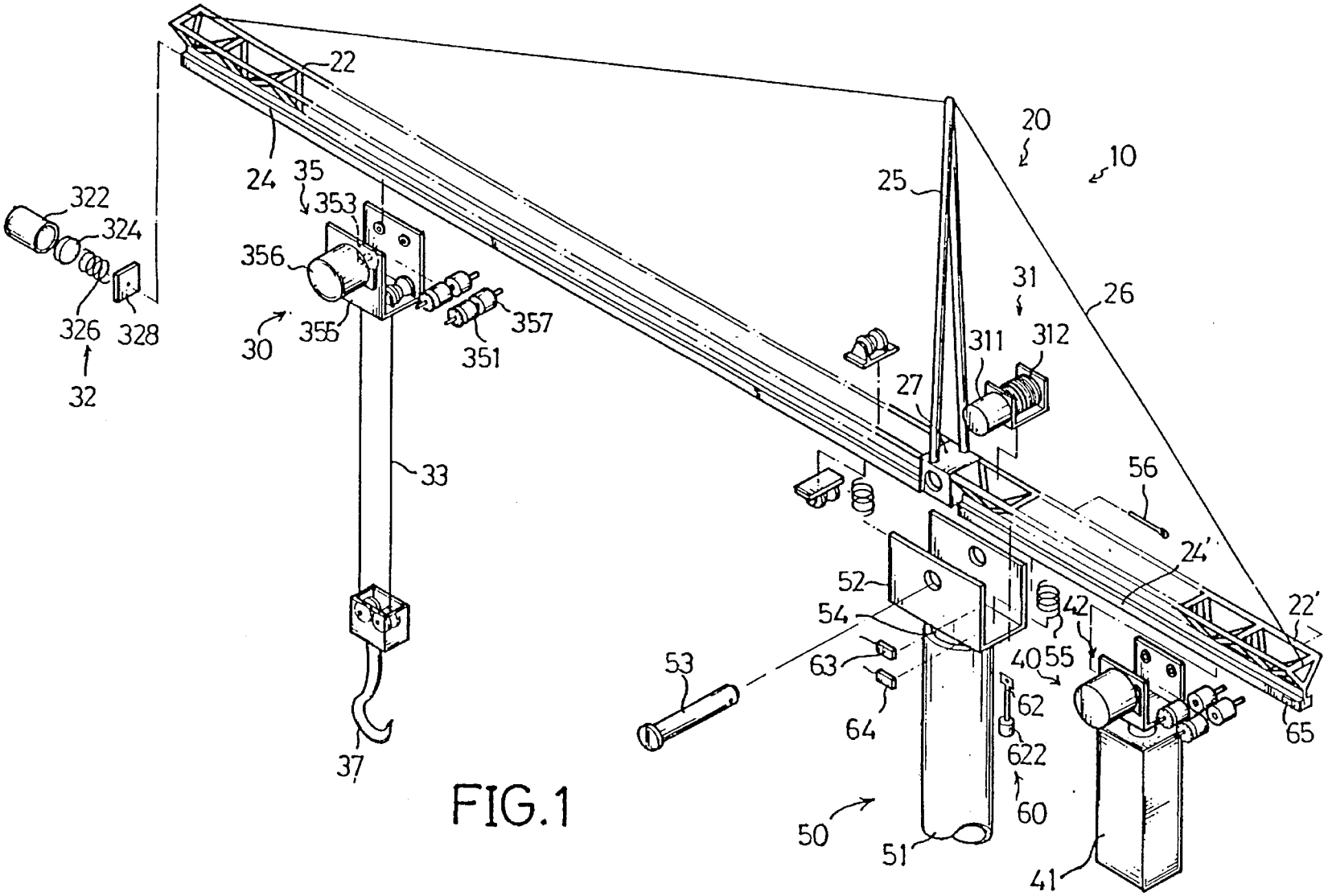
FIG. 1 is an exploded, top-front-right perspective view showing a derrick in accordance with the present invention.

Referring to FIG. 1, a derrick in accordance with the present invention is generally indicated by reference number 10. The derrick 10 generally consists of a boom assembly 20, a hoist assembly 30, a counterweight assembly 40, a base assembly 50 and a controller assembly 60.

The boom assembly 20 consists of a front lattice girder 22 connecting a front rail 24, a rear lattice girder 22' connecting a rear rail 24', a block 27 connecting the front girder 22 and the rail 24 and the rear girder 22' and the rail 24' together, two poles 25 being erected from the block 27 and connecting to each other at top ends thereof, two tensioning cables 26 respectively extend from the top ends of the poles 25 to be fastened to a front-most end and a rear-most end of the front and rear girders 22, 22' respectively thereby to enhance rigidity of the boom assembly 20.

Figure 7:
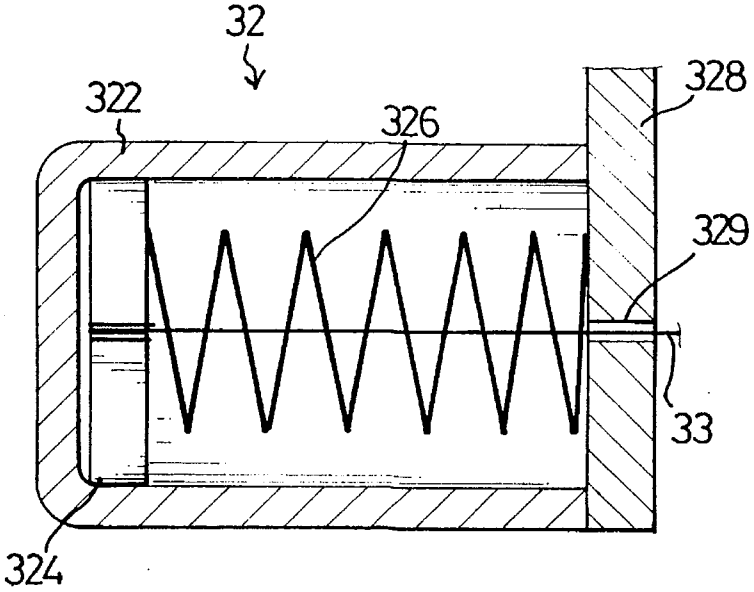
FIG. 7 is a cross-sectional view in an enlarged scale showing the details of a cushioning mechanism of the present invention.

The hoist assembly 30 comprises a winch 31 having a motor 311 driving a reel 312, a steel wire 33 extending from the reel 312 through a series of pulleys to connect with a hook 37 to drive lifting and lowering of the hook 37, and a first dolly 35 for moving the hook 37 along the front rail 24. The winch 31 is fixedly mounted on the rear girder 22' near the block 27. The first dolly 35 is slideably mounted on the front rail 24. The steel wire 33 has one end fixedly attached to the reel 312 and the other end fixedly attached to a cushioning mechanism 32 attached on a front-most end of the front rail Referring to FIG. 7, the cushioning mechanism 32 comprises a mounting plate 328 fixedly attached to the front-most end face of the front rail by a known means, for example, welding. The mounting plate 328 defines a hole 329 for the steel wire 33 to extend therethrough. A housing 322 is fixedly attached on the mounting plate 328. An anchor 324 is slideably mounted in the housing 322 wherein the end of the steel wire 33, which is fixedly attached to the cushioning mechanism 32 is fixedly anchored on the anchor 324. A spring 326 is mounted in the housing and located between the anchor 324 and the mounting plate 328 to exert a cushioning force on the anchor 324, and, thus, the steel wire 33.

Also referring to FIG. 1, when the motor 311 is activated to rotate the reel 312 to pull the steel wire 33 to lift the hook 37 to start hoisting an article (not shown), firstly the steel wire 33 will pull the anchor 324 to move it toward the mounting plate 328 to gradually compress the spring 326 whereby the initial hoisting force of the hook acting on the article can be gradually increased to prevent a sudden application of the hosting force on the article.

The first dolly 35 comprises a housing 355 having a generally U-shaped configuration. A motor 356 is attached to a side wall of the housing 355. The motor 356 can receive an electricity supply to drive a gear 353 to rotate. Two pairs of rollers 351 and 357 are each mounted on two side walls of the housing 355.

Figure 6:
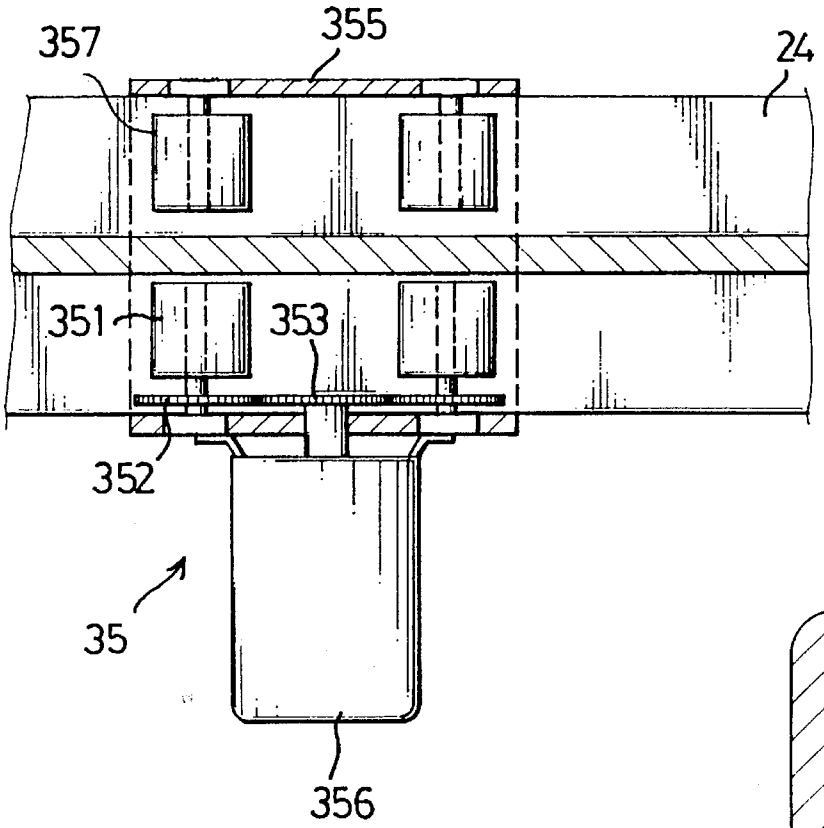
FIG. 6 is cross-sectional view taken from line 6—6 of FIG. 2.

Now turn to FIG. 6, which shows the detailed structure of the first dolly 35 and how the motor 356 can drive the first dolly 35 to move along the front rail 24. Each of the rollers 351 and 357 has a shaft rotatably mounted on the respective side wall of the housing 355 by, for example, engaging each of the shafts of the rollers 351 and 357 with a bearing fixedly mounted on the respective side wall of the housing 355. Furthermore, the rollers 351 and 357 are engaged with a top face of the front rail 24. Each of the rollers 351 has a gear 352 fixedly mounted on its shaft and meshing with the gear 353 drivably connected with the motor 356 so that when the motor 356 is activated, it can drive the first dolly 35 to move along the rail 24.

Referring back to FIG. 1, the counterweight assembly 40 has a counterweight 41 fixedly attached to a bottom of a second dolly 42 which is slideably mounted on the rear rail 24'. Since the structure of the second dolly 42 is the same as that of the first dolly 35, a detailed disclosure about the second dolly 42 is omitted. The second dolly 42 can function to move the counterweight 41 along the rear rail 24'.

The base assembly 50 comprises a column 51 for supporting the whole weight of the derrick 10. A bracket 52 which has a generally U-shaped configuration in which a central span between two perpendicular sides is lowermost and horizontal is rotatably mounted on the column 51 via a bearing 54 which is fixedly mounted on a top of the column 51. A bottom end of the column 51 is fixedly mounted on a stable base (not shown). A shaft 53 is used to extend through two bores defined in the bracket 52 and a hole defined in the block 27 thereby to pivotably mount the boom assembly 20 on the base assembly 50 so that the boom assembly 20 can have a substantially vertically pivotable movement about the base assembly 50. A pin 56 is used to fixedly engage in a pin hole defined on an end of the shaft 53 thereby to firmly mount the shaft 53 on the bracket 52. Two springs 55 are mounted to be compressed between a bottom wall of the bracket 52 and a respective bottom face respective of the front and rear rails 24, 24' thereby to provide a cushioning force on the boom assembly 20 to prevent the boom assembly 20 from having a too quick pivotal movement about the bracket 52 in response to an unbalanced state of the boom assembly 20 due to the loading of a heavy article hoisted by the hook 37 being not balanced by the counterweight 41.

The controlling assembly 60 includes a controlling rod 62 and two limit switches 63, 64. The controlling rod 62 has a top end mounted on a side of the rear rail 24' and a bottom end having an enlarged portion 622. The limit switches 63, 64 are mounted on an inside of a side wall of the bracket 52. The limit switches 63, 64 are arranged in a straight line and spaced from each other a distance. Each of the limit switches 63, 64 is electrically connected to an electrical control circuit (not shown) for controlling the driving of the motors 356, 311 and the motor of the second dolly 42. Since the electrical control circuit can have a variety of designs which are known by those skilled in the art and do not fall within the scope of the present invention, a detailed description about the electrical control circuit will not be made here.

Now refer to FIGS. 2, 3, 4 and 5 which show different operating stages of the present invention and illustrate how the present invention is operated to enable the counterweight 41 to effectively balance the loading of the article that is hoisted by the present derrick 10.

Figure 2:
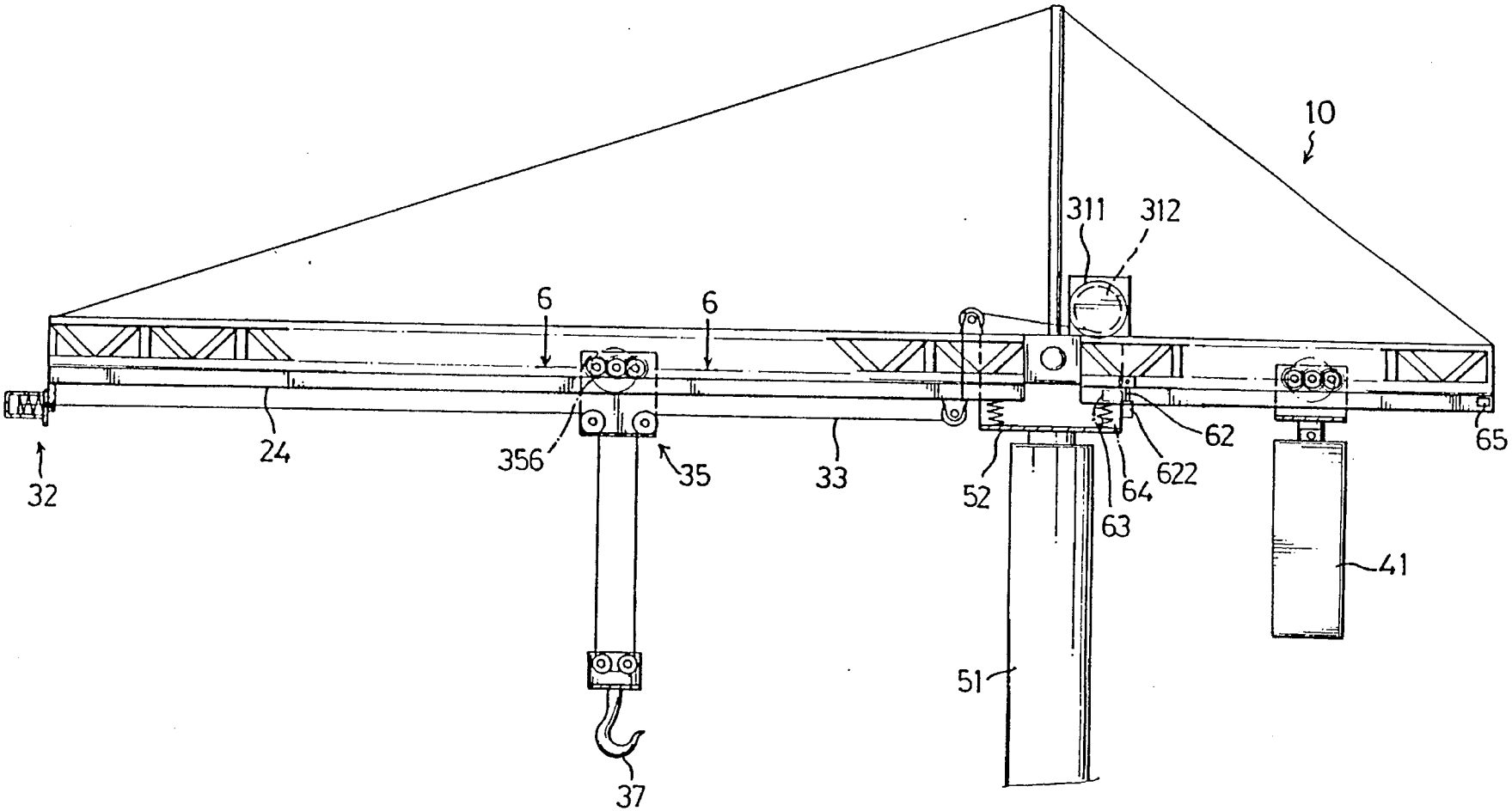
FIG. 2 is a front view showing a first condition during an operation of the present invention.

Firstly refer to FIG. 2 which shows that the present derrick 10 is in a balanced state while no loading is hoisted by the hook 37. In this balanced state, the enlarged portion 622 of the controlling rod 62 is positioned between the limit switches 63 and 64 and does not have any contact therewith (hereafter, this position is defined as a "neutral position"), in which the electrical control circuit is set to a first operating mode. In this first operating mode, the operator can operate the electrical control circuit by means of, for example, pushing two push buttons, to respectively activate the motor 311 to rotate the reel 312 to lift/lower the hook 37 or to activate the motor 356 to move the first dolly 35 together with the hook 37 along the front rail 24.

Figure 3:
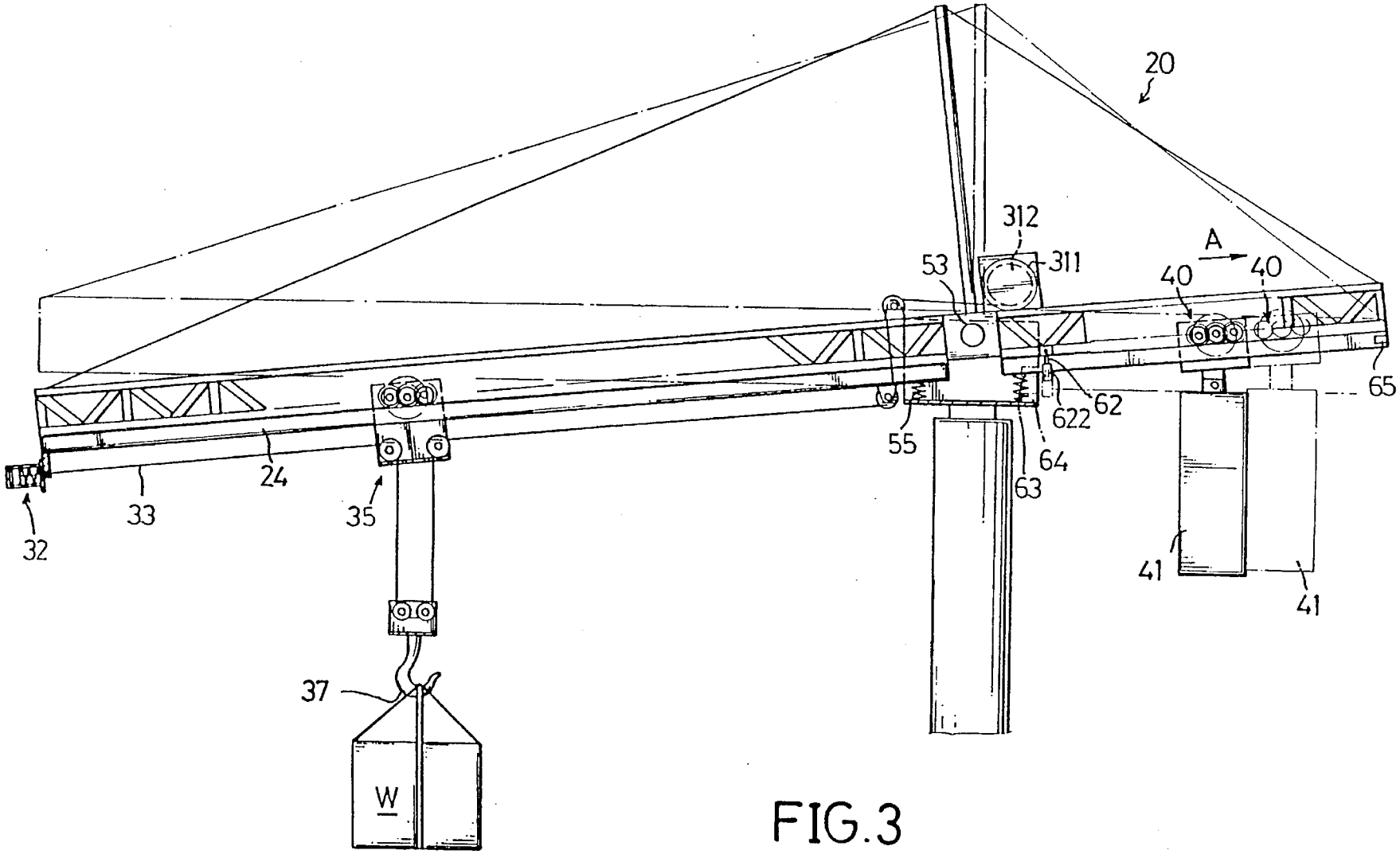
FIG. 3 is a view similar to FIG. 2 but showing a second condition during the operation of the present invention.

After the first dolly 35 is moved along the front rail 24 to a position wherein a heavy article W (FIG. 3) which is intended to be hoisted by the present derrick 10 is located, the hook 37 is lowered by pushing a "DOWN" button to hook the article W, and, then, hoist the article W upwardly by pushing an "UP" button, as shown in FIG. 3. At this moment, an unbalanced moment is produced on the boom assembly 20 about the shaft 53 so that the boom assembly 20 is inclined forwardly when the moment generated by the loading of the article W about the shaft 53 is sufficiently large, as shown in FIG. 3, one of the springs 55 near the first dolly 35 is further compressed and the controlling rod 62 is moved upwardly so its enlarged portion 622 is contacted with and activates the limit switch 63 whereby the electrical control circuit is changed from its first operating mode to a second operating mode.

Figure 4:
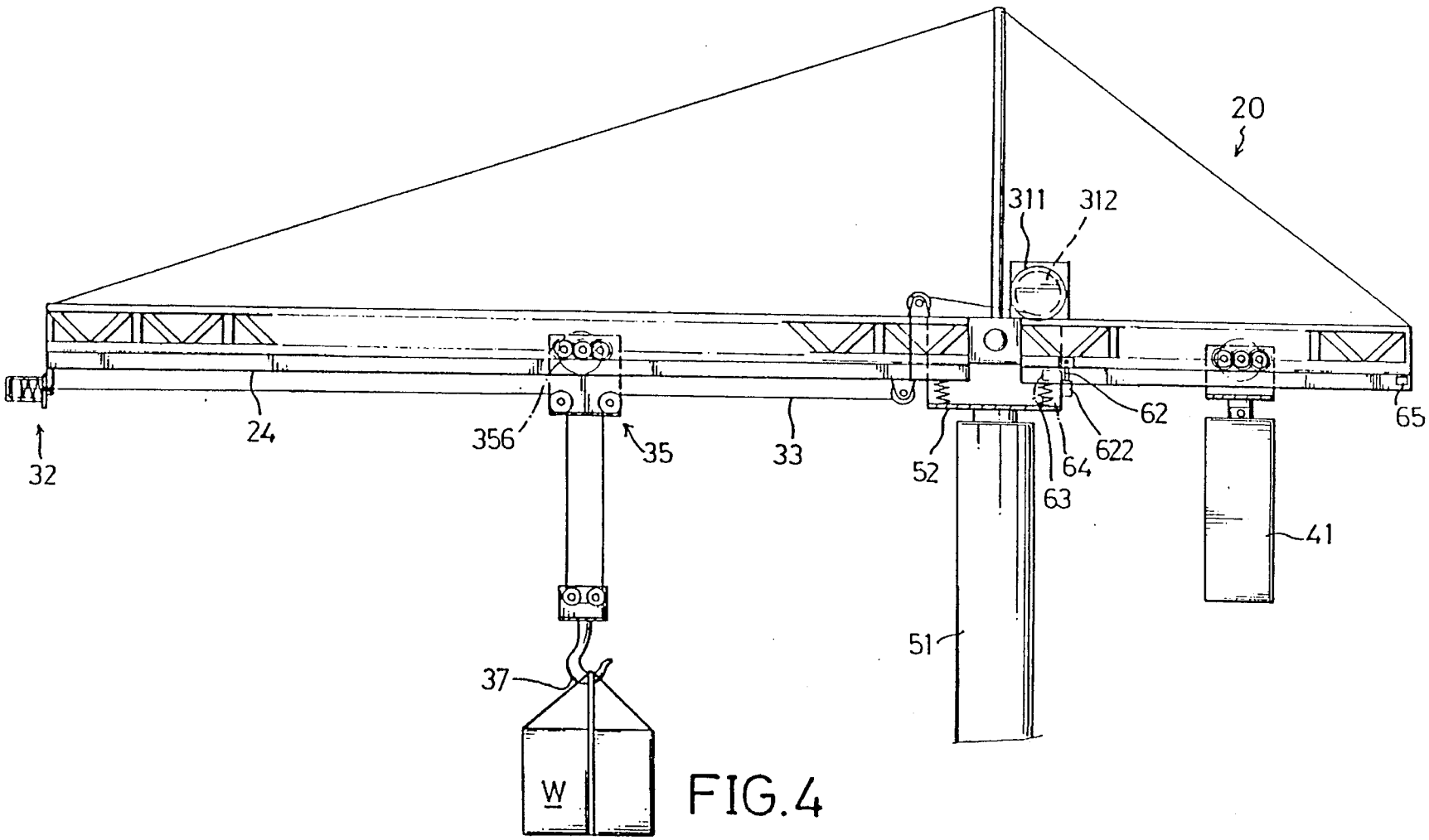
FIG. 4 is a view similar to FIG. 3 but showing a third condition during the operation of the present invention.

At the second operating mode, the controlling circuit will interrupt the running of the motor 311 and activate the motor of the second dolly 42 to move the counterweight 41 toward a rear end of the rear rail 24' as indicated by the arrow A until the second dolly 42 together with the counterweight 41 reaches a position indicated by the phantom lines in FIG. 3, in which the moment generated by the loading of the article W about the shaft 53 is balanced by the moment generated by the counterweight 41 about the shaft 53 so that the boom assembly 20 is returned to its balanced state (i.e. a horizontal state) as indicated by FIG. 4.

Referring to FIG. 4, once the boom assembly 20 is returned from its forwardly inclined position to the horizontal position, the controlling rod 62 is moved downwardly and its enlarged portion 622 is returned to its neutral position in which it will not contact with the limit switch 63 and its activation thereon is released whereby the operating mode of the electrical control circuit is changed from the second operating mode to the first operating mode, wherein the running of the motor of the second dolly 42 is stopped and the running of the motor 311 continues to hoist the article W to a required level which may be decided by the operator.

Once the article W is hoisted to a required level, the operator will release his (her) actuation of the "UP" button and actuate, for example, a "RIGHT" button to start the running of the motor 356 of the first dolly 35 to move the article W toward a right side of FIG. 4 provided that the article is required to be transported toward a position near the column 51 when the article W has reached the desired level.

Figure 5:
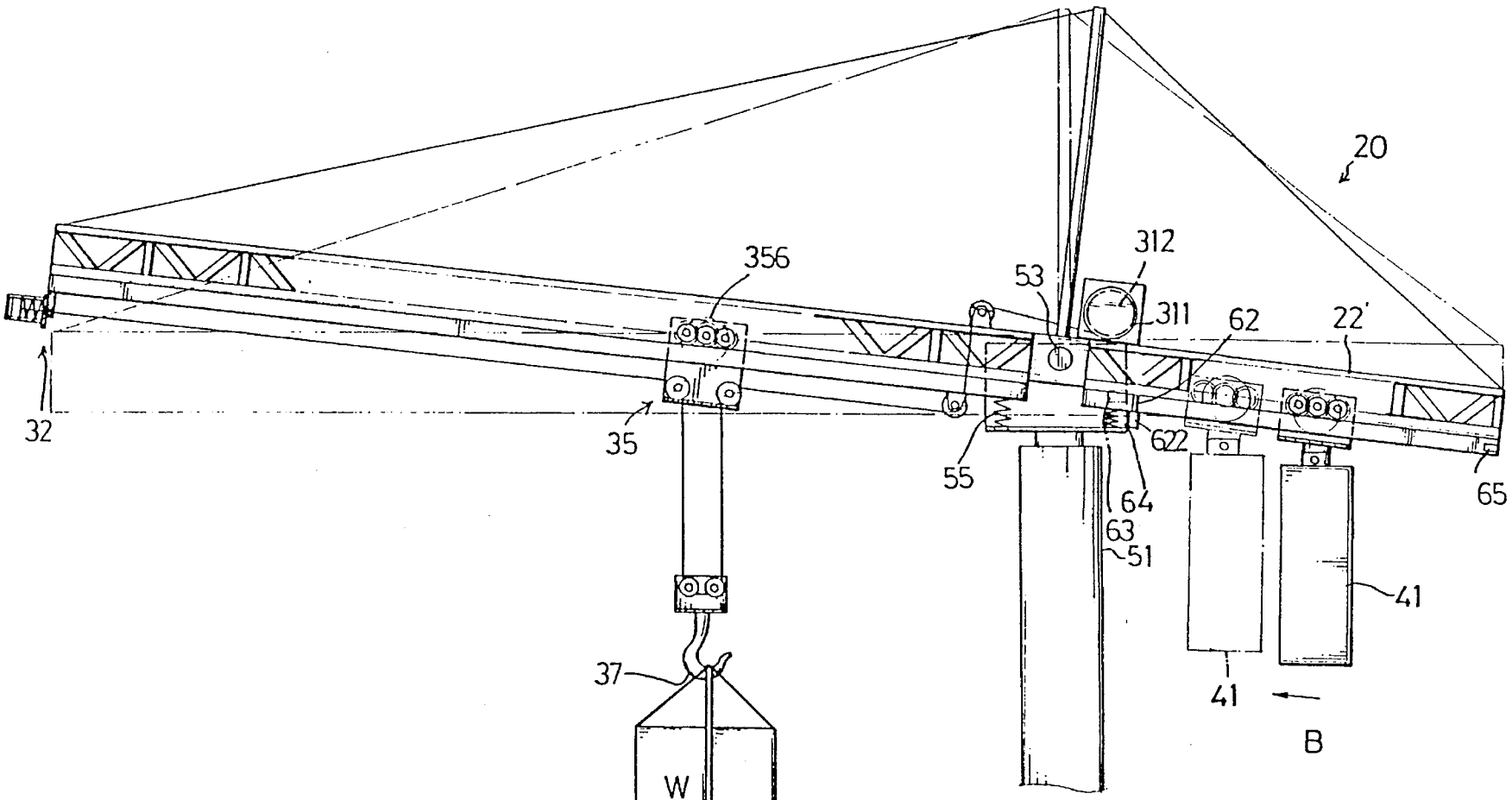
FIG. 5 is a view similar to FIG. 4 but showing a fourth condition during the operation of the present invention.

Referring to FIG. 5, once the article W is moved to the right a predetermined distance in which the moment generated by the loading of the article W about the shaft 53 is sufficiently less than that generated by the counterweight 41, the boom assembly 20 is inclined rearward in which the controlling rod 62 is moved downwardly so that its enlarged portion 622 is in contact with and activates the limit switch 64 to change the electrical control circuit from the first operating mode to a third operating mode.

When the controlling circuit is changed from the first operating mode to the third operating mode, it will interrupt the running of the motor 356 and start the motor of the second dolly 42 to move the counterweight 41 toward the column 51 as indicated by arrow B until the second dolly 42 together with the counterweight 41 reaches a position as indicated by the phantom lines in which the boom assembly 20 is returned to its balanced state (i.e., horizontal position) so that the enlarged portion 622 of the rod 62 will return to its neutral position and the electric control circuit will change from its third operating mode to the first operating mode.

Once the electric control circuit returns to its first operating mode, the running of the motor of the second dolly 42 is stopped and the motor 356 continues until the operator releases his (her) actuation of the "RIGHT" button, or the article W is moved to the right to a position in which the enlarged portion 622 of the rod 62 is moved downwardly again to contact with the limit switch 64.

Referring to FIGS. 1 to 5, a further limit switch 65 is mounted on a rear-most end of the rear rail 24' whereby during the operation of the present derrick 10 once the second dolly 42 is moved rearward to actuate the limit switch 65, due to, for example, the loading of the article W exceeding the rating loading that the present derrick 10 is designed to hoist, no matter in which mode the control circuit is, the control circuit will be forced to become a fourth operating mode. In the fourth operating mode of the control circuit, a horn is activated to;sound and the running of the motor of the second dolly 42 is interrupted thereby to prevent the second dolly 42 from moving out of the rear rail 24' and afford the present invention a secure manner to prevent the present derrick 10 from hoisting an article whose loading exceeds the rating loading that the present derrick 10 is designed to hoist.

Although it is not shown by the present invention, it can be appreciated by those skilled in the art that an additional motor and a transmission mechanism can be provided to the present invention to horizontally rotate the boom assembly 20 about the column 51 through the bearing 54.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An improved derrick structure, comprising:

a column;

a bracket substantially horizontally and rotatably mounted on the column;

a boom vertically pivotably mounted on the bracket to divide the boom into a first portion and a second portion;

two springs respectively compressed between the bracket and the first portion of the boom and the second portion of the boom;

hoisting means adapted to transport a heavy article, comprising:

a winch fixedly mounted on the boom and drivable to generate a hoisting force;

a flexible force transmission member connected to the winch;

engaging means adapted to engage a heavy article to be transported and connected to the flexible force transmission member to receive the hoisting force of the winch to have a substantially vertical movement; and a first dolly slideably mounted on the first portion of the boom and drivable to move the engaging means along the first portion of the boom;

a counterweight assembly drivable to move along the second portion of the boom; and controlling means adapted to be connected to an electrical control circuit for controlling the driving of the winch, the first dolly and the counterweight assembly, having a first portion mounted on the boom and a second portion mounted on the bracket and shiftable between a first position and a second position and the first position and a third position, wherein when in the first position, in which the boom is in a substantially horizontal position, the winch and the first dolly are drivable to hoist the engaging means and move the engaging means along the first portion of the boom, further wherein when in the second position, in which the first portion of the boom is pivoted upwardly, the winch and the first dolly cannot be driven to hoist the engaging means and move the engaging means along the first portion of the boom and the counterweight assembly is driven to move along the second portion of the boom toward the bracket, and also wherein when in the third position, in which the first portion of the boom is pivoted downwardly, the winch and the first dolly also cannot be driven to hoist the engaging means and move the engaging means along the first portion of the boom and the counterweight assembly is driven to move along the second portion of the boom away from the bracket.

2. The derrick structure in accordance with claim 1, wherein the first portion of the controlling means defines an activating region, and the second portion of the controlling means comprises a first sensor and a second sensor, and wherein in the first position, the activating region does not act on any one of the sensors, in the second position, the activating region acts on the first sensor and in the third position, the activating region acts on the second sensor.

3. The derrick structure in accordance with claim 2, wherein the first and second sensors are respectively a first limit switch and a second switch arranged in a straight line and spaced from each other a distance and the first portion of the controlling means is a rod having an enlarged bottom end defining the activating region, and wherein in the first position, the enlarged bottom end of the rod does not contact any one of the two limit switches, in the second position, the enlarged bottom end is moved to contact the first limit switch, and in the third position, the enlarged bottom end is moved to contact the second limit switch.

4. The derrick structure in accordance with claim 1, wherein the winch comprises a motor and a reel driven by the motor, and the flexible force transmission member is a steel wire having one end fixedly attached on the reel and another end attached on a cushioning mechanism.

5. The derrick structure in accordance with claim 4, wherein the cushioning mechanism comprises a mounting plate fixedly attached on the first portion of the boom and defining a hole for the wire to extend therethrough, a housing fixedly attached on mounting plate, an anchor slideably mounted in the housing and fixedly anchoring said another end of the wire, and a spring mounted in the housing to exert a spring force on the anchor in a direction opposite to a pulling direction of said another end of the wire.

6. The derrick structure in accordance with claim 1, wherein the controlling means further comprises a sensor positioned on the second portion of the boom whereby when the counterweight assembly is driven to move away from the base to contact with the sensor, the moving of the counterweight assembly is stopped.

7. The derrick structure in accordance with claim 1, wherein the counterweight assembly comprises a second dolly drivable to move along the second portion of the boom and a counterweight fixedly attached on a bottom of the second dolly.

8. The derrick structure in accordance with claim 7, wherein each of the first and second dollies comprises a housing, a motor fixedly mounted on the housing, at least two pairs of rollers rotatably mounted on the housing and engaging the boom wherein one pair of the rollers are drivably connected with the motor.

* * * * *